US012234070B2

(12) United States Patent
Simpson et al.

(10) Patent No.: US 12,234,070 B2
(45) Date of Patent: Feb. 25, 2025

(54) CONTAINER DEVICE AND METHOD FOR SECURING SAME

(71) Applicant: RxGuardian Inc., Sacramento, CA (US)

(72) Inventors: Joseph Simpson, Lincoln, CA (US); Nathan Langley, Sacramento, CA (US)

(73) Assignee: RxGuardian Inc., Sacramento, CA (US)

( * ) Notice: Subject to any disclaimer, the term of this patent is extended or adjusted under 35 U.S.C. 154(b) by 0 days.

(21) Appl. No.: 15/338,133

(22) Filed: Oct. 28, 2016

(65) Prior Publication Data

US 2018/0079569 A1 Mar. 22, 2018

(51) Int. Cl.
*B65D 55/14* (2006.01)
*B65D 43/16* (2006.01)

(52) U.S. Cl.
CPC ..... *B65D 55/145* (2013.01); *B65D 43/16* (2013.01); *Y10T 29/49826* (2015.01); *Y10T 70/554* (2015.04)

(58) Field of Classification Search
CPC ..... B65D 55/145; B65D 55/14; B65D 55/02; B65D 5/0085
USPC ..... 220/4.21, 4.22, 4.23, 4.24
See application file for complete search history.

(56) References Cited

U.S. PATENT DOCUMENTS 684,656 A 10/1901 Watson
1,071,991 A 9/1913 Ebert
1,082,906 A 12/1913 Potts
1,358,352 A 11/1920 Wheelock
1,361,605 A 12/1920 Morrill
1,683,294 A 9/1928 Edgar
1,803,217 A 4/1931 Strayer
1,986,057 A 7/1932 Hackworth
2,009,216 A * 7/1935 Anibal ..... B65D 55/14 215/206
2,017,698 A 10/1935 Levy
2,064,432 A 12/1936 Keidel
(Continued)

FOREIGN PATENT DOCUMENTS

CN 2646078 Y 10/2004
CN 2897860 Y 5/2007
(Continued)

OTHER PUBLICATIONS

First Office Action for CN 201080049649.2 (English and Chinese; dated Dec. 25, 2013 (15 pgs.) PCT/US2010/047589 International Preliminary Report Search Report dated Mar. 6, 2012 (7 pages).
(Continued)

*Primary Examiner* — Jeffrey R Allen
(74) *Attorney, Agent, or Firm* — Eversheds Sutherland (US) LLP; Regis C. Worley, Jr.

(57) ABSTRACT

A container device and lock and method for locking the container device are disclosed. The container device may be a clam shell container which is secured with a twist on closure. This clam shell container allows for storage of items which are larger than the neck size of a twist-on closure. The container device may have wings on the side of the closure to secure a tight fit with a gasket to make the device water and smell resistant. This device can be used to secure items from unauthorized users. Medications are a common item which can be secured within this device.

21 Claims, 6 Drawing Sheets

(56) References Cited

U.S. PATENT DOCUMENTS 2,136,598 A 11/1938 Strayer
2,616,470 A 11/1952 Rifkin et al.
3,141,221 A 7/1964 Faulls
3,151,756 A 10/1964 Gruen
3,200,868 A 8/1965 Strayer
3,266,711 A 8/1966 Song
3,394,959 A 7/1968 Hoffmann
3,421,347 A 1/1969 Sotory
3,426,932 A 2/1969 Rouse
3,445,021 A 5/1969 Johnson
3,481,007 A 12/1969 Scarritt, Jr.
3,669,296 A 6/1972 Drew et al.
3,684,117 A 8/1972 Leopoldi et al.
3,702,169 A 11/1972 Bonneville et al.
3,843,007 A 10/1974 Meyer
3,850,324 A 11/1974 Meyer
3,901,407 A 8/1975 Mitchell et al.
3,998,078 A 12/1976 Detwiler
4,302,956 A 12/1981 McMorrow et al.
4,366,687 A 1/1983 Atkinson
4,383,425 A 5/1983 Orabona
4,445,348 A 5/1984 Saitoh
4,520,641 A 6/1985 Bako
4,615,191 A 10/1986 Grandy
4,787,222 A 11/1988 Irazoqui et al.
4,794,768 A 1/1989 Moser et al.
4,829,796 A 5/1989 Kim
4,871,264 A 10/1989 Robbins
4,907,430 A 3/1990 Hong
4,984,698 A 1/1991 Stuckey
5,050,272 A 9/1991 Robinson et al.
5,142,888 A 9/1992 Ling
D331,364 S 12/1992 Barker et al.
5,277,325 A 1/1994 Yan
5,284,262 A 2/1994 O'Nan
5,379,489 A 1/1995 Delk et al.
5,429,263 A 7/1995 Haubenwallner et al.
5,493,279 A 2/1996 Dawson et al.
D372,674 S 8/1996 Weber et al.
D376,691 S 12/1996 Naas et al.
5,613,282 A 3/1997 Deddens et al.
5,619,775 A 4/1997 Klinck
5,636,539 A 6/1997 Tsai
5,681,115 A 10/1997 Diederich et al.
5,713,108 A 2/1998 Solomon et al.
5,735,422 A 4/1998 Binter
5,797,683 A 8/1998 Gunzi et al.
5,799,792 A * 9/1998 Abrums ..... B65D 21/0233 206/501
5,875,657 A 3/1999 Kelley
5,899,099 A 5/1999 Tsai
5,911,764 A 6/1999 Wei Kong
5,913,456 A 6/1999 Dikeman
5,983,460 A 11/1999 Hyde et al.
6,074,094 A 6/2000 Manolizi et al.
6,290,393 B1 9/2001 Tomic
6,386,005 B1 5/2002 Kuo
6,688,146 B2 2/2004 Michels et al.
6,702,169 B2 3/2004 Eipper
6,786,346 B1 9/2004 Gurnard et al.
6,793,081 B1 9/2004 Derman
6,912,878 B2 7/2005 Beldeti, Jr.
6,988,642 B2 1/2006 Gallo, Jr. et al.
7,107,803 B1 9/2006 Swanson
7,243,515 B2 7/2007 Meyer
7,252,204 B1 8/2007 Small
7,337,637 B2 3/2008 Kan
7,347,325 B2 * 3/2008 O'Neill ..... A45C 1/06 206/38
7,350,655 B2 4/2008 Belden, Jr.
7,412,854 B2 8/2008 Raemisch et al.
7,503,696 B2 3/2009 Ha et al.
7,549,541 B2 * 6/2009 Brozell ..... B65D 83/0463 206/531
7,617,935 B2 * 11/2009 Reilley ..... A61J 7/00 206/1.5
7,677,065 B1 3/2010 Miao et al.
7,891,220 B2 2/2011 Yen
8,020,415 B2 * 9/2011 Corbin ..... B65D 55/145 70/168
8,297,087 B1 10/2012 Lin
8,413,811 B1 * 4/2013 Arendt ..... A61C 8/0087 206/365
8,517,193 B1 8/2013 Small
8,662,330 B2 3/2014 Simposn
8,666,539 B2 3/2014 Ervin
8,875,915 B2 11/2014 Serell
8,931,652 B2 1/2015 Simposn
8,938,999 B2 1/2015 Dahl
8,939,301 B1 1/2015 Small
8,944,263 B1 2/2015 Michels et al.
9,078,502 B2 7/2015 Fily et al.
9,133,649 B2 9/2015 Taylor et al.
D741,713 S 10/2015 Serell
D742,116 S 11/2015 Serell
D746,058 S * 12/2015 Serell ..... D3/203.1
9,199,773 B2 12/2015 Simpson
D747,606 S 1/2016 Serell
D747,607 S 1/2016 Serell
9,278,789 B2 3/2016 Simpson
9,367,984 B2 6/2016 Daugbjerg et al.
D761,008 S * 7/2016 Lande ..... D3/203.2
9,452,872 B2 9/2016 Simpson
9,555,942 B2 1/2017 Ackerman
9,573,743 B2 2/2017 Simpson
9,758,989 B1 9/2017 Simpson
9,764,882 B2 9/2017 Simpson
9,890,558 B2 2/2018 Serell
10,037,640 B2 7/2018 Gordon
10,145,492 B2 12/2018 Ayala, Jr. et al.
10,180,018 B1 1/2019 Simpson et al.
10,279,969 B2 5/2019 Simpson
10,335,349 B2 7/2019 Roslyakov et al.
10,472,857 B2 11/2019 Simpson
10,717,571 B1 7/2020 Simpson et al.
11,008,777 B2 5/2021 Simpson
11,238,682 B2 2/2022 Poddar
11,262,148 B1 3/2022 Lessie et al.
11,279,535 B1 3/2022 Simpson et al.
2002/0170639 A1 11/2002 Steinberg
2003/0089145 A1 5/2003 Michels et al.
2003/0188510 A1 10/2003 Vargas
2004/0011098 A1 1/2004 Yang
2004/0163430 A1 8/2004 Belden
2004/0234173 A1 11/2004 Saad et al.
2005/0050853 A1 3/2005 Byron et al.
2005/0278186 A1 12/2005 De la Huerga
2006/0037370 A1 2/2006 Bright
2006/0207958 A1 9/2006 Hamer
2007/0023317 A1 2/2007 Brozell et al.
2007/0131007 A1 6/2007 Hacker
2008/0098939 A1 5/2008 Kalous et al.
2008/0302794 A1 12/2008 Wagner et al.
2009/0108016 A1 4/2009 Brown et al.
2010/0307208 A1 12/2010 Corbin et al.
2011/0049079 A1 3/2011 Simpson
2011/0049080 A1 3/2011 Simpson
2011/0079058 A1 4/2011 Nielsen
2011/0021036 A1 9/2011 Wang
2011/0210136 A1 9/2011 Wang
2012/0168461 A1 7/2012 Topits et al.
2012/0267369 A1 * 10/2012 Duvigneau ..... B65D 81/262 220/203.01
2013/0043204 A1 2/2013 Simpson
2013/0062303 A1 3/2013 Serell
2013/0134121 A1 5/2013 Dahl
2014/0116536 A1 5/2014 Resendiz
2014/0158558 A1 6/2014 Ye
2014/0175041 A1 6/2014 Simpson
2014/0360969 A1 * 12/2014 Ackerman ..... B65D 50/062 215/206
2015/0351513 A1 12/2015 Park
2016/0083157 A1 3/2016 Simpson et al.

(56) References Cited

U.S. PATENT DOCUMENTS

| | | | |
|---|---|---|---|
| 2016/0185497 | A1 | 6/2016 | Simpson |
| 2017/0001777 | A1 | 1/2017 | Simpson |
| 2017/0137190 | A1 | 5/2017 | Simpson |
| 2017/0356217 | A1 | 12/2017 | Simpson |
| 2018/0051488 | A1 | 2/2018 | Simpson |
| 2018/0061157 | A1 | 3/2018 | Zielkowski et al. |
| 2019/0104876 | A1 | 4/2019 | Loures et al. |
| 2020/0024866 | A1 | 1/2020 | Hartmann et al. |
| 2020/0040606 | A1 | 2/2020 | Simpson |
| 2020/0062472 | A1 | 2/2020 | Simpson |
| 2020/0346826 | A1 | 11/2020 | Simpson et al. |
| 2021/0340792 | A1 | 11/2021 | Simpson |
| 2021/0354891 | A1 | 11/2021 | Netter |

FOREIGN PATENT DOCUMENTS

| | | | |
|---|---|---|---|
| CN | 201143150 | Y | 11/2008 |
| CN | 103043295 | A | 4/2013 |
| GB | 495955 | A | 11/1938 |
| WO | WO9521982 | A1 | 8/1995 |
| WO | WO9857863 | A1 | 12/1998 |
| WO | WO0208078 | A2 | 1/2002 |
| WO | WO2004103827 | A2 | 12/2004 |
| WO | WO2006058418 | A1 | 6/2006 |
| WO | WO2010078898 | A1 | 7/2010 |
| WO | WO2012112633 | A1 | 8/2012 |

OTHER PUBLICATIONS

PCT/2010/047589 International Preliminary Report Search Report dated Mar. 6, 2012 (7 pages).

PCT International Search Report of PCT/US10/47589; dated Oct. 22, 2010 (2 pgs.).

PCT Written Opinion of PCT/US10/47589; dated Oct. 22, 2010 (6 pgs.).

Extended European Search Report of EP 10814459.3; dated Dec. 12, 2012 (4 pages).

International Search Report and Written Opinion for International Application No. PCT/US2017/047651, mailed Oct. 27, 2017, 8 pages.

International Search Report and Written Opinion for International Application No. PCT/US2017/058959, mailed Jan. 17, 2018, 7 pages.

* cited by examiner

CONTAINER DEVICE AND METHOD FOR SECURING SAME

RELATED PATENT APPLICATION/PRIORITY CLAIMS

This patent application is related to U.S. patent application Ser. No. 13/585,742, filed on Aug. 14, 2014, now U.S. Pat. No. 9,199,773, and entitled "Lockable Cap for a Bottle," which in turn is a divisional of and claims priority under 35 USC 120 to U.S. patent application Ser. No. 12/730,812, filed on Mar. 24, 2010, now U.S. Pat. No. 8,931,652, and entitled "Lockable Cap for a Bottle," which in turn is a continuation in part of and claims priority under 35 USC 120 to U.S. patent application Ser. No. 12/573,799, filed on Oct. 5, 2009, now U.S. Pat. No. 8,662,330, and entitled "Lockable Cap for Medical Prescription Bottle" which in turn claims the benefit under 35 USC 119 (e) to U.S. Provisional application Ser. No. 61/239,597 and entitled "Lockable Cap for Medical Prescription Bottle" filed on Sep. 3, 2009, the entire contents of each of which are incorporated herein fully by reference.

FIELD

The disclosure relates generally to a locking container device.

BACKGROUND

Bottles that may be locked to prevent access to the contents of the bottle, such as a medication, by an unauthorized user exist. These bottles, however, only allow items that are as big as the neck of the bottle (which is typically smaller than the bottle) to be securely stored in the bottle. Thus, it is desirable to provide a container device that allows items larger than the neck of the bottle to be securely stored using the container device.

DETAILED DESCRIPTION OF ONE OR MORE EMBODIMENTS

The disclosure is particularly applicable to a clamshell container device that uses a twist-on combination lock to secure the contents of the clamshell container device and it is in this context that the disclosure will be described. It will be appreciated, however, that the container device and method has greater utility since the container device may be of different sizes and shapes that those of the embodiment shown and/or may use other types of locking devices to secure the contents of the container device.

In one embodiment shown in FIGS. 1-5, the container device 2 may be rectangularly-shaped clamshell container with a neck portion. However, the container device may be various different shapes (square, spherical, etc.), may have different sizes (as compared to the lunch box sized container device is FIGS. 1-5) and may have many different designs besides the clamshell device shown in FIGS. 1-5 and the container device is not limited to any particular size, shape or design.

In one embodiment, the container device may be a clam shell container which is secured with a locking device. This clam shell container allows for storage of items which are larger than the neck size of the container device. The locking device may be a twist-on closure, a 4 digit combination locking cap or any other locking device that may be attached to a neck of the container device and locked so that the contents within the container device are secured from unauthorized access as long as the locking device is locked. The locking device may be opened by providing the appropriate open code, such as a correct open 4 digit combination if a 4 digit combination lock is being used. Furthermore, the locking device may provide a mechanism to reset the password of the locking device. The use of a lid on the closure holds the container shut so, when closed, the contents inside are secure. A hinge allows for larger items to be stored within the container regardless of its smaller closure size. There may be wings on the side of the closure to secure a tight fit with a gasket to make the device water and smell resistant. This device can be used to secure items from unauthorized users. Medications are a common item which can be secured within this device.

Figure 1:
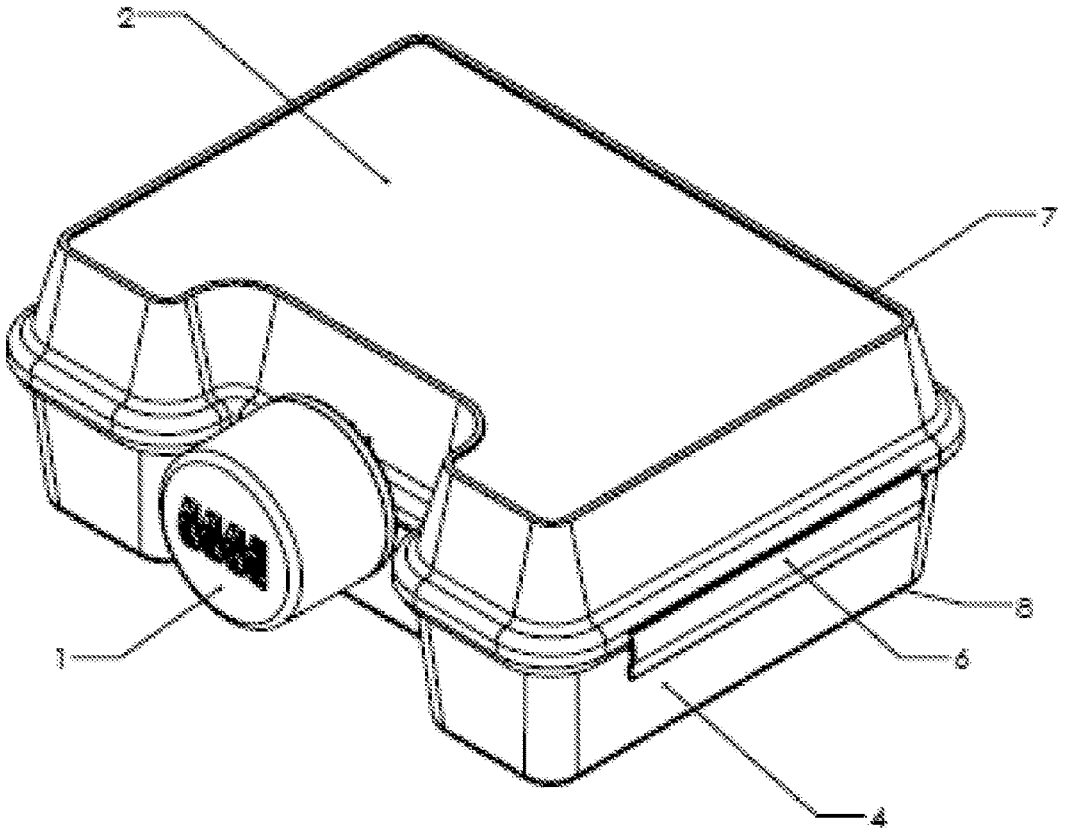
FIG. 1 illustrates a container device in a closed and locked state.
Figure 3:
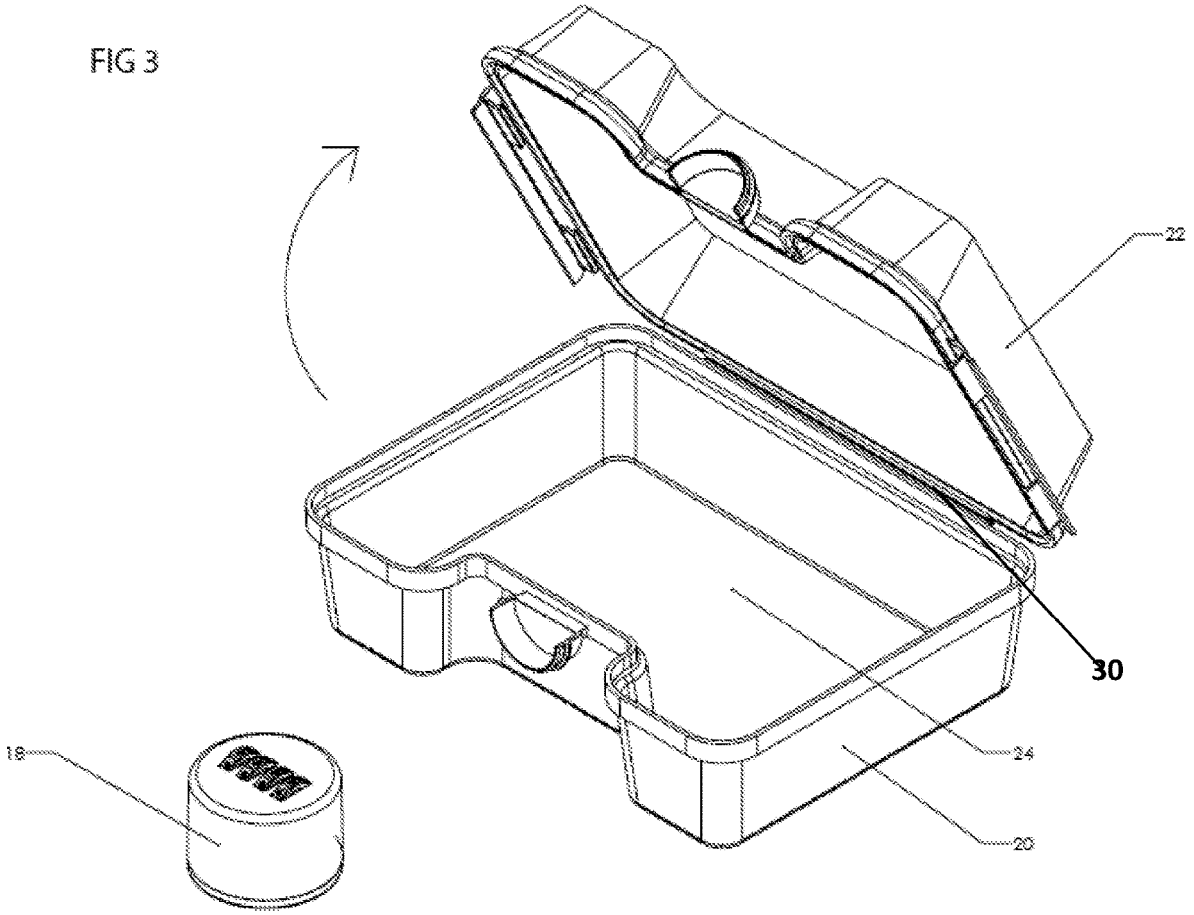
FIG. 3 illustrates the container device in an open and unlocked state.

FIG. 1 illustrates a container device 2 in a closed and locked state. More specifically, FIG. 1 is an isometric view of the container device 2, such as a clam shell container in one embodiment with a locking device 1, such as a twist on closure in one embodiment. As shown in FIG. 1, the container device 2 has a neck portion (obscured in FIG. 1 by the locking device 1) around which the locking device may be placed and then locked to prevent access to the contents inside of the container device while the container device is locked. In one embodiment, the locking device 1 may be threaded onto the neck of the container device. The neck portion may have two halves as shown in FIG. 3. The container 2 may have an upper housing portion 7 and a lower housing portion 4 that may fit together and seal as shown in FIG. 1.

The locking device 1 may be a combination locking closure (1), but any locking closure or twist-on closure can be used to seal this container in the closed position. In one implementation, the locking closure may be a 4 symbol combination locking cap as disclosed in U.S. Pat. No. 8,931,652, issued on Jan. 13, 2015, U.S. Pat. No. 9,199,773, issued on Dec. 1, 2015 and U.S. patent application Ser. No. 14/954,686, file Nov. 30, 2015, all of are owned by the same assignee as this application and all of which are incorporated by reference herein.

The container 2, when in a closed position as shown in Figure, may have one or more sets of clip wings 6 (shown in a downward position in FIG. 1) that allow for a better seal between the upper housing portion 7 and the lower housing portion 4 of the container. The container 2 allows for the secure storage of items that could not fit through the neck portion of the container. The container 2 is only locked when it is used in conjunction with a locking cap, but the container 2 is sealed shut when the wing clips are down and/or a cap is screwed onto the threads on the neck. In some embodiments, a cap from a standard 38 mm pill enclosure may fit the threads on the neck, however a locking cap as described below may be used instead of a standard pill cap to lock the box.

Figure 2:
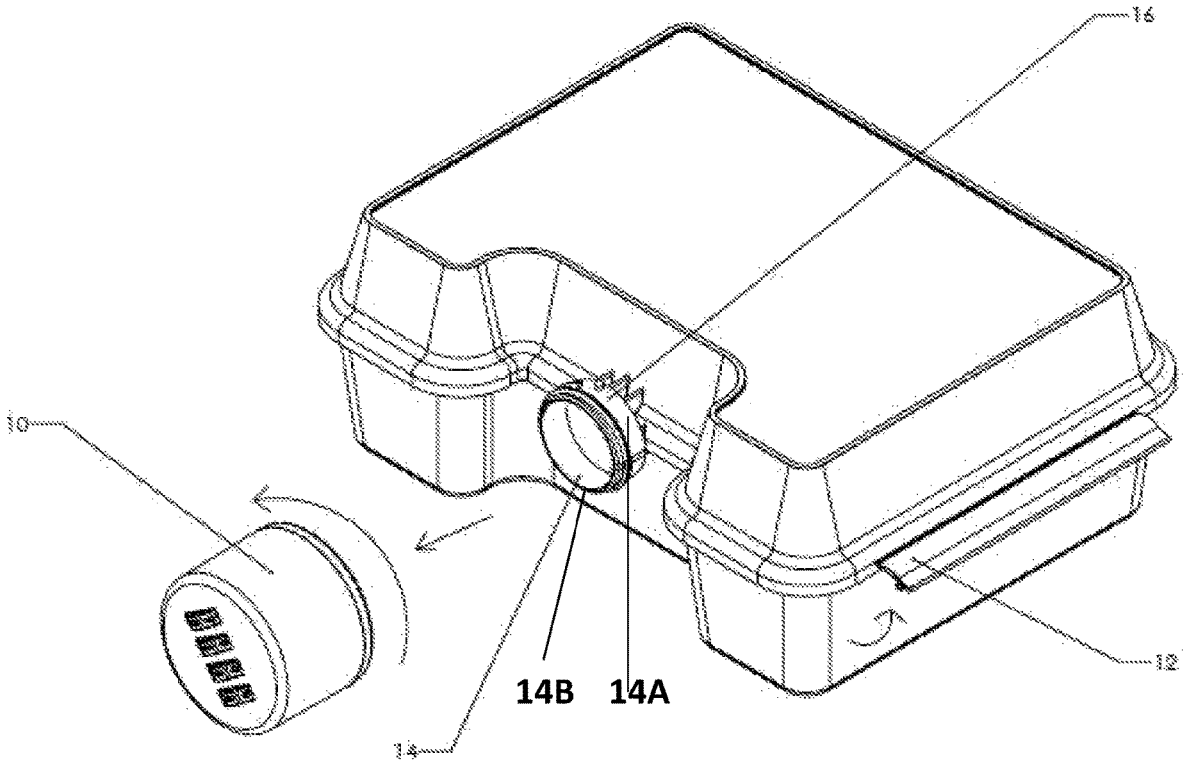
FIG. 2 illustrates the container device is a closed, but unlocked state when the locking device has been removed from the container device.

FIG. 2 illustrates the container device 2 in a closed, but unlocked state when the locking device 10 has been removed from the container device 2. FIG. 2 further illustrates an example of a neck portion 14 that has a set of threads 16 onto which the locking device 10 may be threaded and twisted onto the container and locked so that the locking device 10 locks the container so that the contents of the container cannot be removed until the locking device is unlocked and removed. For example, a user may enter a lock code into the locking device to set the lock code, place the locking code onto the neck portion of the container and scramble the code on the locking device so that the locking device is locked onto the neck portion of the container. When the user wants to remove the locking device from the container, the user may enter the unlock code (such as an unlock combination in a combination lock) into the locking device that unlocks and allow the locking device to be removed from the container. The locking device may also have a mechanism that allows the user to change/reset the unlock code of the locking device. An example of the locking, unlocking and reset operations of the locking device when the locking device is a 4 symbol combination lock cap may be found in U.S. Pat. No. 8,931,652, issued on Jan. 13, 2015, U.S. Pat. No. 9,199,773, issued on Dec. 1, 2015 and U.S. patent application Ser. No. 14/954,686, file Nov. 30, 2015, all of are owned by the same assignee as this application and all of which are incorporated by reference herein. The locking cap twists onto the container similar to the locking cap described above.

As shown in FIG. 2, the neck portion 14 may have a top neck portion 14A and a bottom neck portion 14B that, when the container 2 is closed as shown in FIG. 2, for the neck portion 14 onto which the locking device 10 may be placed. FIG. 2 also shows the wings 6, 12 in an open position, upwards, not engaging the lower part of the container whereas FIG. 1 shows the wings 6 in a down, closed position.

FIG. 3 illustrates the container device 2 in an open and unlocked state. In one implementation as shown in FIG. 3, the upper and lower housing portions may be hinged at a back portion using a hinge 30 so that the upper housing portion 22 and lower housing portion 20 can lift away from each other for a user to store items in a middle open region of the container (24). The length width and height of the container can be adjusted to different sizes. Furthermore, the internal space of the container may include shelves, dividers, clips, restraints so that the user can place certain items into/onto these shelves, dividers, clips or restraints. For example, the inside of the container may have restraints that may be attached to items to prevent the items from moving around inside of the container while the container is locked.

Figure 4:
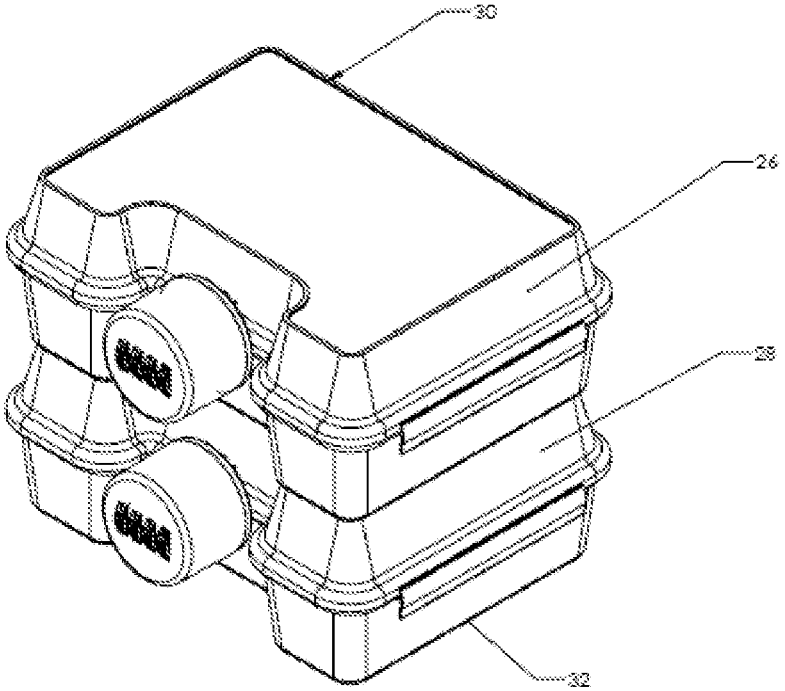
FIG. 4 illustrates stacked container devices.

FIG. 4 illustrates stacked container devices with multiple clam shell containers stacked together. Note that each container device has its own locking device on the neck of the container. The containers may be stacked on top of each other for transport or storage. In one implementation, a top face 26 on the upper housing portion may have a lip 30 around the perimeter which fits together with a foot located at the perimeter of the bottom face on the bottom shell at the position to allow these containers to be stacked together.

Figure 5:
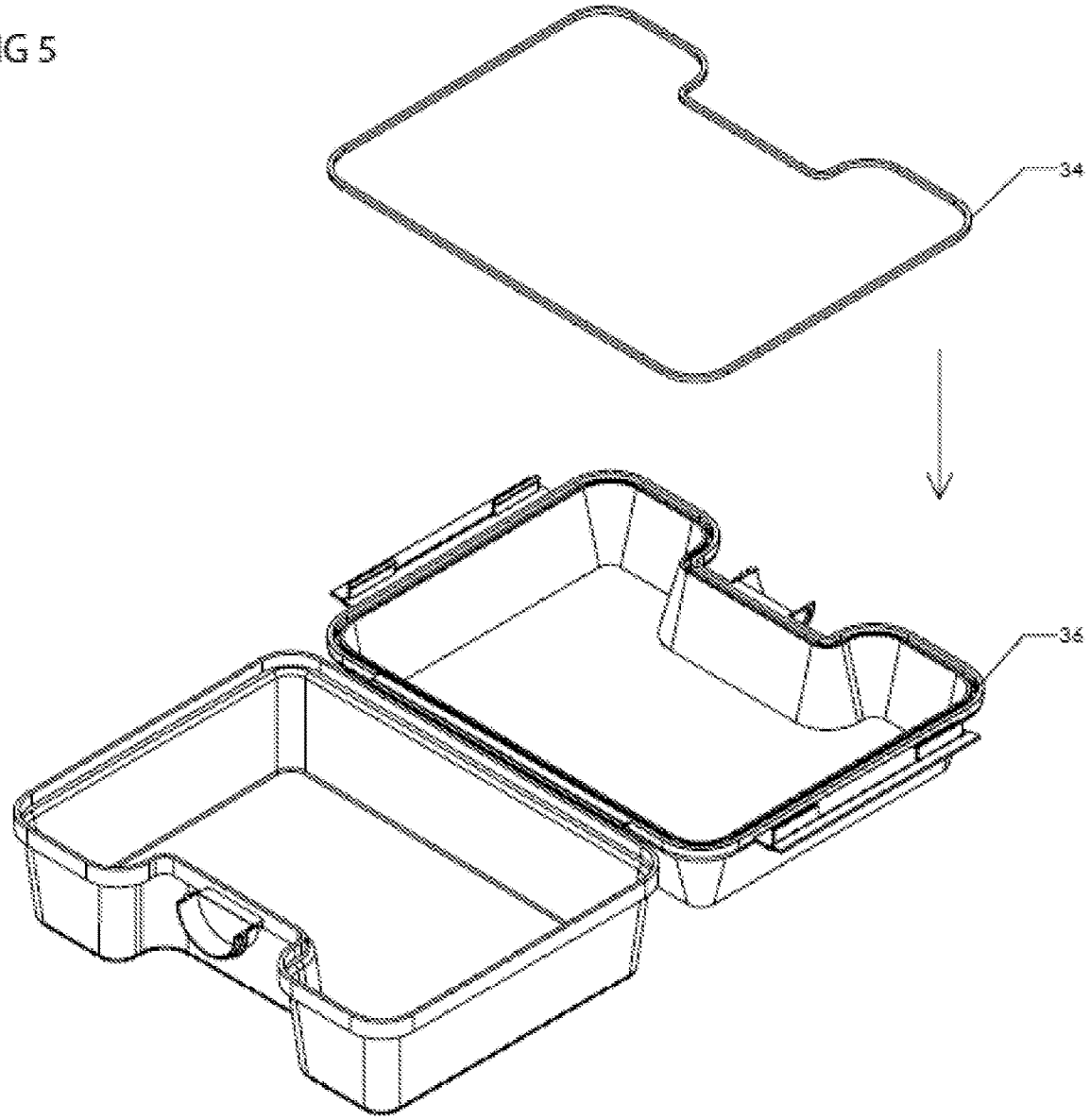
FIG. 5 the container device with a gasket seal.

FIG. 5 the container device with a gasket seal 34. The gasket 34 fits into a groove 36 on the upper portion of the housing. The seal 34 allows for the container device, when closed, to be water and smell resistant.

Figure 6:
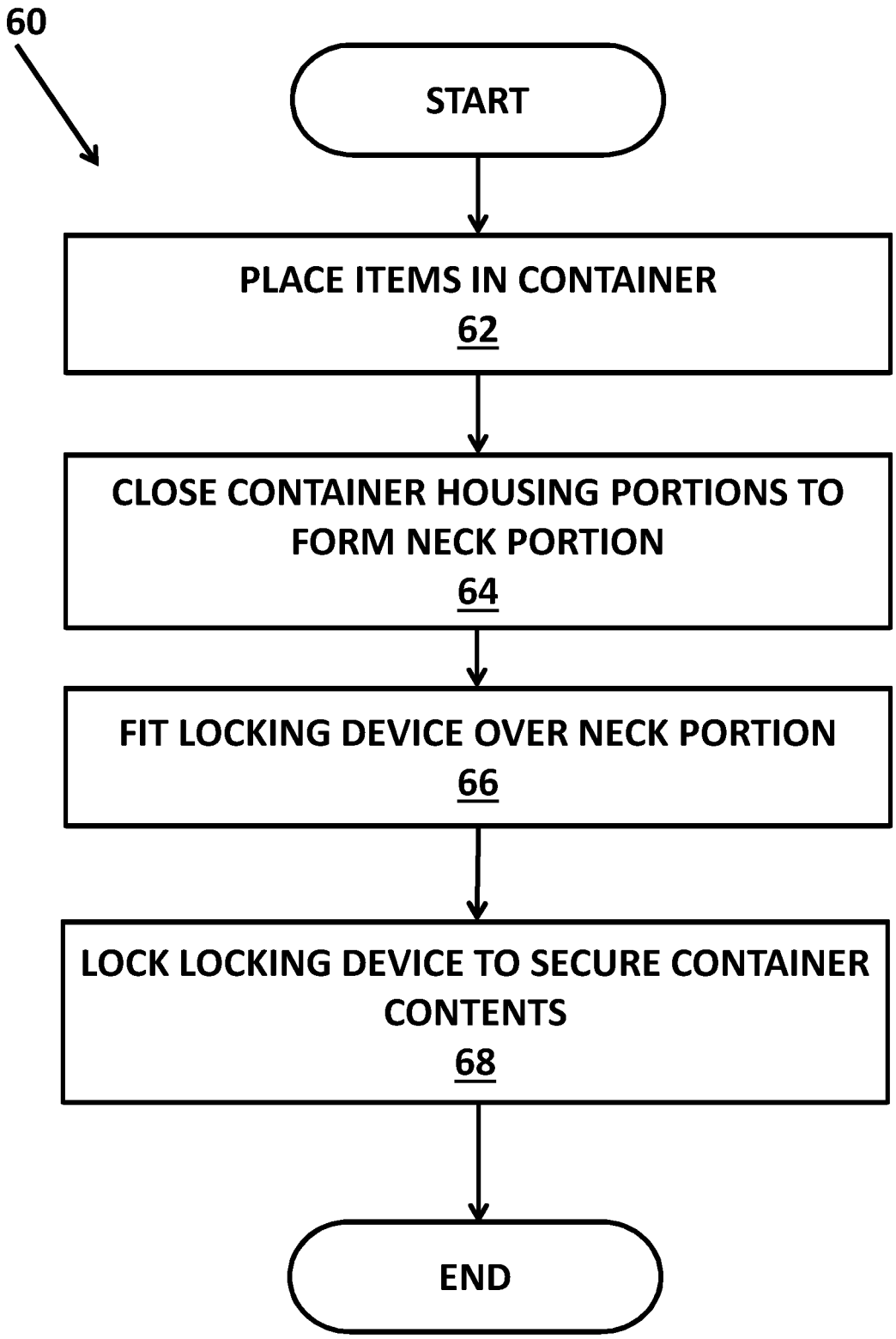
FIG. 6 is a flowchart of a method for operating a locking container.

FIG. 6 is a flowchart of a method 60 for operating a locking container. The below method assumes that the user has already set/selected an unlock code for the locking device. A user may place items to be secured into the open container (62). The use may then close the container so that the upper and lower housing portions form a neck portion (64). A locking device may then be fit over the neck portion (66). In one implementation, the locking device may be twisted onto the neck portion. In another implementation, the neck portion may have a set of threads and the locking device may be threaded onto the neck portion. The locking device may then be locked (68) as described above so that the contents in the closed container are secured. In one implementation, the user may enter a lock code into the locking device. In another implementation, the user may enter a combination other than the unlock combination into a combination lock that locks the locking device. The user may then unlock the container and the locking device by entering the unlock code or the unlock combination. The container device also allows the user, when the locking device is unlocked, to reset the unlock code or unlock combination.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. The embodiments were chosen and described in order to best explain the principles of the disclosure and its practical applications, to thereby enable others skilled in the art to best utilize the disclosure and various embodiments with various modifications as are suited to the particular use contemplated.

The system and method disclosed herein may be implemented via one or more components, systems, servers, appliances, other subcomponents, or distributed between such elements. When implemented as a system, such systems may include an/or involve, inter alia, components such as software modules, general-purpose CPU, RAM, etc. found in general-purpose computers. In implementations where the innovations reside on a server, such a server may include or involve components such as CPU, RAM, etc., such as those found in general-purpose computers.

Additionally, the system and method herein may be achieved via implementations with disparate or entirely different software, hardware and/or firmware components, beyond that set forth above. With regard to such other components (e.g., software, processing components, etc.) and/or computer-readable media associated with or embodying the present inventions, for example, aspects of the innovations herein may be implemented consistent with numerous general purpose or special purpose computing systems or configurations. Various exemplary computing systems, environments, and/or configurations that may be suitable for use with the innovations herein may include, but are not limited to: software or other components within or embodied on personal computers, servers or server computing devices such as routing/connectivity components, handheld or laptop devices, multiprocessor systems, microprocessor-based systems, set top boxes, consumer electronic devices, network PCs, other existing computer platforms, distributed computing environments that include one or more of the above systems or devices, etc.

In some instances, aspects of the system and method may be achieved via or performed by logic and/or logic instructions including program modules, executed in association with such components or circuitry, for example. In general, program modules may include routines, programs, objects, components, data structures, etc. that perform particular tasks or implement particular instructions herein. The inventions may also be practiced in the context of distributed software, computer, or circuit settings where circuitry is connected via communication buses, circuitry or links. In distributed settings, control/instructions may occur from both local and remote computer storage media including memory storage devices.

The software, circuitry and components herein may also include and/or utilize one or more type of computer readable media. Computer readable media can be any available media that is resident on, associable with, or can be accessed by such circuits and/or computing components. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic tape, magnetic disk storage or other magnetic storage devices, or any other medium which can be used to store the desired information and can accessed by computing component. Communication media may comprise computer readable instructions, data structures, program modules and/or other components. Further, communication media may include wired media such as a wired network or direct-wired connection, however no media of any such type herein includes transitory media. Combinations of the any of the above are also included within the scope of computer readable media.

In the present description, the terms component, module, device, etc. may refer to any type of logical or functional software elements, circuits, blocks and/or processes that may be implemented in a variety of ways. For example, the functions of various circuits and/or blocks can be combined with one another into any other number of modules. Each module may even be implemented as a software program stored on a tangible memory (e.g., random access memory, read only memory, CD-ROM memory, hard disk drive, etc.) to be read by a central processing unit to implement the functions of the innovations herein. Or, the modules can comprise programming instructions transmitted to a general purpose computer or to processing/graphics hardware via a transmission carrier wave. Also, the modules can be implemented as hardware logic circuitry implementing the functions encompassed by the innovations herein. Finally, the modules can be implemented using special purpose instructions (SIMD instructions), field programmable logic arrays or any mix thereof which provides the desired level performance and cost.

As disclosed herein, features consistent with the disclosure may be implemented via computer-hardware, software and/or firmware. For example, the systems and methods disclosed herein may be embodied in various forms including, for example, a data processor, such as a computer that also includes a database, digital electronic circuitry, firmware, software, or in combinations of them. Further, while some of the disclosed implementations describe specific hardware components, systems and methods consistent with the innovations herein may be implemented with any combination of hardware, software and/or firmware. Moreover, the above-noted features and other aspects and principles of the innovations herein may be implemented in various environments. Such environments and related applications may be specially constructed for performing the various routines, processes and/or operations according to the invention or they may include a general-purpose computer or computing platform selectively activated or reconfigured by code to provide the necessary functionality. The processes disclosed herein are not inherently related to any particular computer, network, architecture, environment, or other apparatus, and may be implemented by a suitable combination of hardware, software, and/or firmware. For example, various general-purpose machines may be used with programs written in accordance with teachings of the invention, or it may be more convenient to construct a specialized apparatus or system to perform the required methods and techniques.

Aspects of the method and system described herein, such as the logic, may also be implemented as functionality programmed into any of a variety of circuitry, including programmable logic devices ("PLDs"), such as field programmable gate arrays ("FPGAs"), programmable array logic ("PAL") devices, electrically programmable logic and memory devices and standard cell-based devices, as well as application specific integrated circuits. Some other possibilities for implementing aspects include: memory devices, microcontrollers with memory (such as EEPROM), embedded microprocessors, firmware, software, etc. Furthermore, aspects may be embodied in microprocessors having software-based circuit emulation, discrete logic (sequential and combinatorial), custom devices, fuzzy (neural) logic, quantum devices, and hybrids of any of the above device types. The underlying device technologies may be provided in a variety of component types, e.g., metal-oxide semiconductor field-effect transistor ("MOSFET") technologies like complementary metal-oxide semiconductor ("CMOS"), bipolar technologies like emitter-coupled logic ("ECL"), polymer technologies (e.g., silicon-conjugated polymer and metal-conjugated polymer-metal structures), mixed analog and digital, and so on.

It should also be noted that the various logic and/or functions disclosed herein may be enabled using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, non-volatile storage media in various forms (e.g., optical, magnetic or semiconductor storage media) though again does not include transitory media. Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Although certain presently preferred implementations of the invention have been specifically described herein, it will be apparent to those skilled in the art to which the invention pertains that variations and modifications of the various implementations shown and described herein may be made without departing from the spirit and scope of the invention. Accordingly, it is intended that the invention be limited only to the extent required by the applicable rules of law.

While the foregoing has been with reference to a particular embodiment of the disclosure, it will be appreciated by those skilled in the art that changes in this embodiment may be made without departing from the principles and spirit of the disclosure, the scope of which is defined by the appended claims.

The invention claimed is:

1. A container device, comprising:

a container housing having an upper container housing portion with a recessed portion with an upper neck portion on a front surface and a lower container housing portion with a recessed portion with a lower neck portion, the container housing forming a recessed neck portion formed by the upper and lower neck portions and an open region inside of the upper and lower container housing portion having a substantially rectangular shape and a flat top portion and a flat bottom portion when the upper and lower container housing portions are fitted together, the recessed neck portion having an external surface defining a set of threads, the upper container housing portion having a first sidewall and a second sidewall each perpendicular to the front surface and opposite each other and each of the first and second sidewalls having a wing extending along substantially an entire length of first and second sidewall respectively and a gasket;

a locking device having a reset hole configured to accommodate axial movement of a reset pin, two or more cutouts on a top surface, and a combination lock integrated into the locking device with two or more wheels wherein each wheel extends through each cutout, wherein the locking device fits over the recessed neck portion of the closed container housing by threading the locking device onto the set of threads wherein the locking device is partially protected by a front surface of the closed container and wherein the locking device that fits over the recessed neck portion is locked and the wing of each sidewall is engaging the lower container housing portion that seals shut the contents inside of the container housing using a combination other than an unlock combination to lock onto the neck portion and preventing removal of the locking device from the neck portion when the container housing is closed and the locking device is locked; and wherein the upper container housing portion has a lip around a periphery of the upper container housing portion and the lower container housing portion has a foot around a periphery of the lower container housing portion so that the container device is capable of being stacked with a second container device with the foot of the second container device fitting together with the lip of the container device.

2. The container device of claim 1, wherein each of the upper container housing portion and lower container housing portion has a partial neck portion, wherein the neck portion of the container housing is formed when the upper and lower container housing portions are fit together to close the container housing.

3. The container device of claim 2, wherein the locking device twists on over the neck portion of the container housing.

4. The container device of claim 1, wherein the locking device is a four digit combination lock.

5. The container device of claim 1, wherein the upper container housing portion and a lower container housing portion are hinged together by a hinge.

6. A method for operating a locking container, comprising:

closing an upper container housing portion with a recessed portion with an upper neck portion on a front surface and a lower container housing portion with a recessed portion with a lower neck portion on a front surface that together to form a housing forming a recessed neck portion of the container and an open region inside of the upper and lower container housing portion having a substantially rectangular shape and a flat top portion and a flat bottom portion is formed when the upper and lower container housing portions are fitted together, wherein closing the housing further comprises closing a wing that extends substantially along an entire length of each of a first sidewall and a second sidewall;

fitting a locking device, having a reset hole configured to accommodate axial movement of a reset pin, two or more cutouts on a top surface, and a combination lock integrated into the locking device with two or more wheels wherein each wheel extends through each cutout, over the recessed neck portion of the closed container housing, wherein the locking device is partially protected by a front surface of the closed container;

entering a combination other than an unlock combination into the locking device to lock the locking device when the locking device is fitted onto the neck portion and the wing of each sidewall is engaging the lower container housing portion that seals shut the contents inside of the container housing by locking onto the neck portion and prevent removal of the locking device from the neck portion when the container housing is closed and the locking device is locked; and pressing the lower container housing portion against a gasket of the upper container housing portion to seal the closed container housing.

7. The method of claim 6 further comprising entering an unlocking code into the locking device to unlock the locking device so that it is removable from the neck portion of the container and the container is capable of being opened.

8. The method of claim 7, wherein fitting the locking device further comprises twisting the locking device onto the neck portion of the container housing.

9. The method of claim 8, wherein twisting the locking device onto the neck portion further comprises threading the locking device onto the neck portion using a set of threads on the neck portion.

10. The container device of claim 1, wherein the container housing has a rectangular shape and the neck portion has a circular shape and the locking device has a circular shape.

11. The container device of claim 1, wherein the front wall portion has an indented region in each of the upper and lower container housing portions and wherein the neck portion is formed in the indented region.

12. The container device of claim 1, wherein the locking device further comprises the reset pin.

13. The container device of claim 1, wherein the recessed neck portion has a 38 mm diameter and the locking device threads onto the 33 mm diameter neck portion.

14. The method of claim 6, further comprising resetting, using the reset pin, the unlock combination.

15. A container device, comprising:

a container housing comprising a first housing portion having a wing clip and a first threaded portion, a second housing portion having a second threaded portion, and a hinge moveably connecting the first housing portion to the second housing portion, the container housing configured to move between an open configuration and a closed configuration; and a cap comprising a locking device, the cap configured to rotatably engage the first threaded portion and the second threaded portion to move between a screwed position and an unscrewed position while the container housing is in the closed configuration, wherein the second housing portion is configured to engage the wing clip to maintain the container housing in the closed position while the wing clip is engaged with the second housing portion, wherein the cap is configured to maintain the container housing in the closed position when the cap is in the screwed position, and wherein the locking device comprises a combination lock configurable to an unlock combination, the locking device configured to prevent the cap from rotating from the screwed position to the unscrewed position unless the combination lock is configured into the unlock combination.

16. A container device comprising:

a container housing comprising an upper container housing portion and a lower container housing portion, the container housing having a front surface, a rear surface, a first sidewall, and a second sidewall defining a substantially rectangular shape, the upper container housing portion movably coupled to a lower container housing portion via a hinge at the rear surface;

a first wing on the first sidewall and a second wing on the second sidewall, the first and second wings configured to lock the upper container housing portion to the lower container housing portion;

a neck portion configured to protrude from the front surface, the neck portion having an external surface defining a set of threads; and a locking device comprising a combination lock integrated into the locking device with two or more wheels, wherein the locking device is configured to fit over the neck portion of the container housing when closed by threading the locking device onto the set of threads, wherein the locking device is configured to lock the neck portion using a combination other than an unlock combination of the two or more wheels of the combination lock.

17. The container device of claim 16, wherein each of the upper container housing portion and lower container housing portion has a partial neck portion, wherein the neck portion of the container housing is formed when the upper and lower container housing portions are fit together to close the container housing.

18. The container device of claim 16, wherein the locking device twists on over the neck portion of the container housing.

19. The container device of claim 16, wherein the combination lock is a four digit combination lock.

20. The container device of claim 16, wherein the neck portion has a substantially circular shape and the locking device has a substantially circular shape.

21. The container device of claim 16, wherein the front surface has an indented region in each of the upper and lower container housing portions and wherein the neck portion is formed in the indented region.

* * * * *